US007641116B2

(12) United States Patent
Haas et al.

(10) Patent No.: US 7,641,116 B2
(45) Date of Patent: Jan. 5, 2010

(54) VOTE BY MAIL ENVELOPE

(75) Inventors: Bertrand Haas, New Haven, CT (US); Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 822 days.

(21) Appl. No.: 11/262,617

(22) Filed: Oct. 31, 2005

(65) Prior Publication Data

US 2007/0095908 A1 May 3, 2007

(51) Int. Cl.
*G07C 13/00* (2006.01)

(52) U.S. Cl. ..... 235/386; 229/301

(58) Field of Classification Search ..... 235/386; 229/301

See application file for complete search history.

(56) References Cited

U.S. PATENT DOCUMENTS 3,652,007 A * 3/1972 MacDougall ..... 229/304
4,237,185 A 12/1980 Lombardi et al.
4,271,227 A 6/1981 Muller et al.
4,416,950 A 11/1983 Muller et al.
4,513,056 A 4/1985 Vernois et al.
4,526,803 A 7/1985 White
4,586,311 A * 5/1986 Becherer et al. ..... 53/381.5
4,597,591 A 7/1986 Gendron et al.
5,207,871 A 5/1993 Murphy et al.
5,294,470 A 3/1994 Ewan
5,418,205 A 5/1995 Mehta et al.
5,811,792 A 9/1998 Verschuur et al.
6,103,355 A 8/2000 Mehta
6,143,120 A 11/2000 Mehta et al.
6,692,819 B1 2/2004 Castle et al.
6,902,770 B1 6/2005 Dulin et al.
7,240,835 B2 7/2007 Brucker et al.
7,441,700 B2 * 10/2008 Haas et al. ..... 235/386
7,467,747 B2 * 12/2008 Haas et al. ..... 235/491
2005/0008836 A1 1/2005 Dulin et al.
2005/0061866 A1 * 3/2005 Ackley et al. ..... 229/306
2008/0121680 A1 5/2008 Quine et al.
2008/0136162 A1 6/2008 Haas et al.
2008/0142594 A1 6/2008 Haas et al.
2008/0143096 A1 6/2008 Haas et al.
2008/0156862 A1 7/2008 Haas et al.

* cited by examiner

*Primary Examiner*—Daniel A Hess
(74) *Attorney, Agent, or Firm*—Brian A. Lemm; Angelo N. Chaclas

(57) ABSTRACT

An envelope for use in containing and authenticating a ballot is presented. The envelope has a containment region dimensioned to receive a ballot or other desired document in accordance with the particular application with which the envelope is used and has a pre-defined area on the back to carry the signature of a person such as a voter using the envelope to vote by mail. A flap portion outside the pre-defined area is used to seal the containment region. A window cover is substantially in registration with the pre-defined signature area to obscure the signature in a first operative configuration and to reveal the pre-defined signature area in a second operative and to re-obscure the signature area after the signature area has been revealed whereby the ballot remains sealed during the pre-defined signature area obscured, revealed and re-obscured configurations. The window cover is arranged for automatic removal by mechanical opening means for automated processing.

17 Claims, 8 Drawing Sheets

VOTE BY MAIL ENVELOPE

FIELD OF THE INVENTION

The present invention relates generally to vote by mail envelopes and deals more particularly with an envelope for use in containing and authenticating a ballot.

BACKGROUND OF THE INVENTION

A variety of subsystems to distribute ballots that individual voters use to record voted selections are utilized in governmental elections in the United States. One such subsystem uses paper ballots that are mailed to the voter who marks the ballot and returns the ballot through the mail. Mailed ballots have been historically reserved for absentee voting. In the usual absentee voting process, the voter marks the ballot to cast his/her vote and then inserts the ballot in a return envelope which is typically pre-addressed to the voter registrar office in the corresponding county, town or locality in which the voter is registered. The voter typically appends his/her signature on the back of the envelope adjacent his/her identification. When the return envelope is received at the registrar's office, a voting official compares the voter signature with the voter signature retrieved from the registration file to make a determination as to whether or not the vote can be considered as authentic.

One general problem with vote by mail envelopes is the signature is in the open and exposed for all to see throughout the process for determining whether or not the vote is authentic during the comparison of the signature recorded on the envelope to the signature retrieved from the registration file which gives rise to privacy issues and concerns. Also, in the prior art system, signatures are exposed to numerous delivery workers throughout the mail delivery process. Further, there is little control over who records the vote thus adding to the issue of privacy concerns. In addition, voting by mail is becoming more prevalent apart from the usual absentee voting and in some western states, entire elections are being conducted exclusively by mail which also give rise to these privacy concerns because of the exposure of the voter's signature on the registrar return envelope.

One possible solution to ensure the privacy of the voter is to have the signature placed below the flap of the envelope so that it is hidden when the envelope is sealed. The flap would have a pre-cut perforated area substantially in registration where it covers the signature. At the registrar's office, a voting official tears off the pre-cut perforated area to open a window thereby revealing the signature to allow the signature to be compared to the signature retrieved from the registration file. The ballot itself however, would remain sealed inside the envelope so that the voting official who authenticates the signature cannot see the ballot. Once the signature has been authenticated, the envelope is opened and the ballot removed and passed onto another voting official to count the votes. The proposed solution is rather cumbersome to do by hand and is virtually impossible to automate and integrate with an automated processing of vote by mail ballots such as for example, a system known as "Relia-Vote" and available from the assignee from the present invention. A further drawback and disadvantage of the proposed solution is once the signature has been revealed, it remains visible to the voting officials who remove the ballots from the envelope to count the votes and to any person authorized or not who happens to be in the vicinity of the signed envelope. Accordingly, the issue of voter privacy is still a concern with the proposed solution.

Accordingly, it would be desirable to provide an envelope for use in containing and authenticating a ballot wherein the privacy of the voter is maintained during the ballot examination and vote counting process.

SUMMARY OF THE INVENTION

In accordance with a broad aspect of the invention, an envelope of use in containing and authenticating a ballot is presented. The envelope has a containment region dimensioned to receive a ballot or other desired document in accordance with the particular application with which the envelope is used and has a pre-defined area on the back to carry the signature of a person such as a voter using the envelope to vote by mail. A flap portion outside the pre-defined area is used to seal the containment region. A window cover is substantially in registration with the pre-defined signature area to obscure the signature in a first operative configuration and to reveal the pre-defined signature area in a second operative configuration (for electronic capture, for example) and to re-obscure the signature area after the signature area has been revealed whereby the ballot remains sealed during the pre-defined signature area obscured, revealed and re-obscured configurations.

Seal strips on the flap portion facing the backside of the envelope when the envelope is closed are located outside the pre-defined signature area and a pre-cut section of the flap portion between the seal strips forms the window cover. In one aspect, a slit located at one end of the pre-cut section receives mechanical opening fingers to automatically remove the window cover when the envelope moves through an automatic opening machine. The pre-defined signature area is re-obscured by an opaque covering that is applied in place of the window covering.

In another aspect, the window cover is formed by a pre-cut section between the seal strips and extends the full width of the flap portion and the opening fingers are received between the flap portion and the backside of the envelope to automatically remove the window cover when the envelope moves through an automatic opening machine. The pre-defined signature area is re-obscured by an opaque covering that is applied in place of the window covering.

In a further aspect, the flap portion has a length dimension greater than the length dimension of the backside of the envelope and a bottom fold over portion which is folded and adhered to the bottom of the address side of the envelope forming a folded flap at the bottom of the envelope to obscure the pre-defined signature area. The folded flap is slit along the bottom to separate the bottom fold over portion from the remaining portion of the flap portion and the window cover formed between the seal strip above the pre-defined signature area and the bottom of the flap portion is lifted away from the backside of the envelope to reveal the pre-defined signature area. The pre-defined signature area is re-obscured by adhering the window cover to the backside of the envelope.

In a still further aspect, the window cover is formed by a transparent material carried on the backside of the envelope and has a sticky surface side and an opposite opaque layer side. The window cover is folded to cover the pre-defined signature area with the sticky side facing the backside of the envelope and the opaque layer side facing outwardly. The pre-defined signature area is revealed by removing the opaque layer to view the pre-defined signature area through the transparent material forming the window cover. The pre-defined signature area is re-obscured by re-applying an opaque layer to the window cover. The opaque layer may be removed with mechanical or chemical means depending on the material used to form the opaque layer.

WRITTEN DESCRIPTION OF PREFERRED EMBODIMENTS

Figure 1:
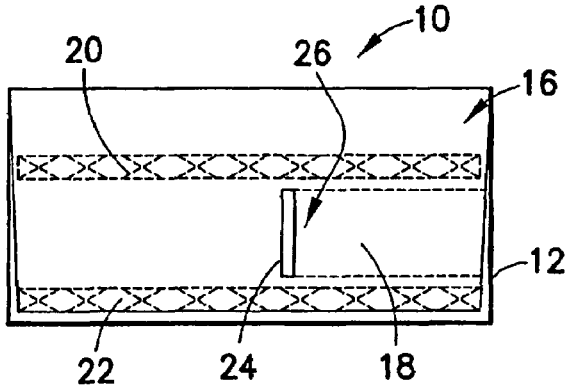
FIG. 1 is a schematic representation of the flap side of an envelope for containing and authenticating a ballot in a first embodiment of the present invention.
Figure 2:
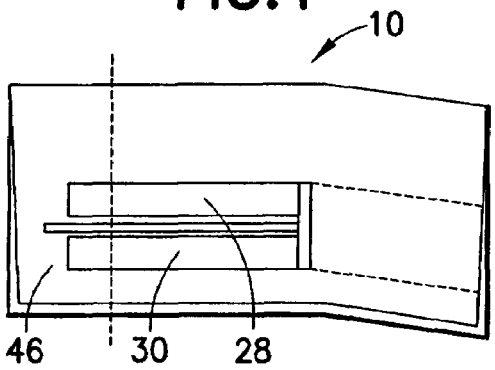
FIG. 2 is a schematic representation of the flap side of the envelope illustrated in FIG. 1 showing fingers of an automated envelope opening system entering the open slit of a pre-cut window covering the signature area.
Figure 3:
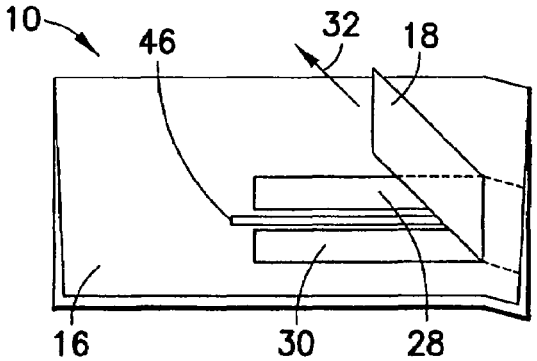
FIG. 3 is a schematic representation of the flap side of the envelope of FIG. 1 showing the pre-cut window cover lifted by the opening fingers for removal from the flap.
Figure 4:
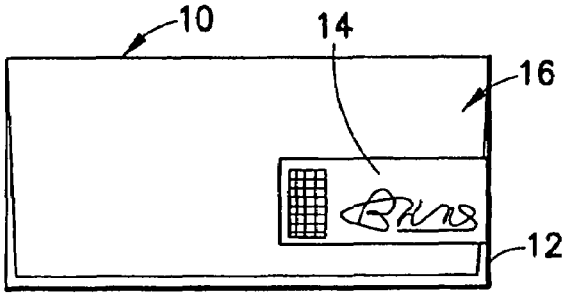
FIG. 4 is a schematic representation of the flap side of the envelope of FIG. 1 showing the signature area of the envelope removed to reveal the signature area.
Figure 5:
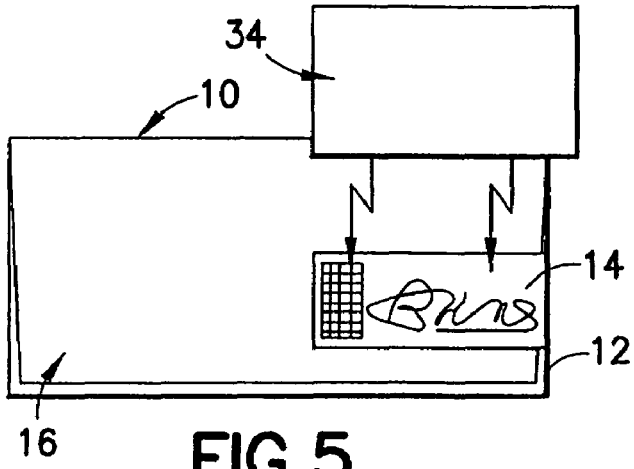
FIG. 5 is a schematic representation of the flap side of the envelope of FIG. 1 showing an opaque sticker applied over the signature area to re-conceal the signature area.
Figure 6:
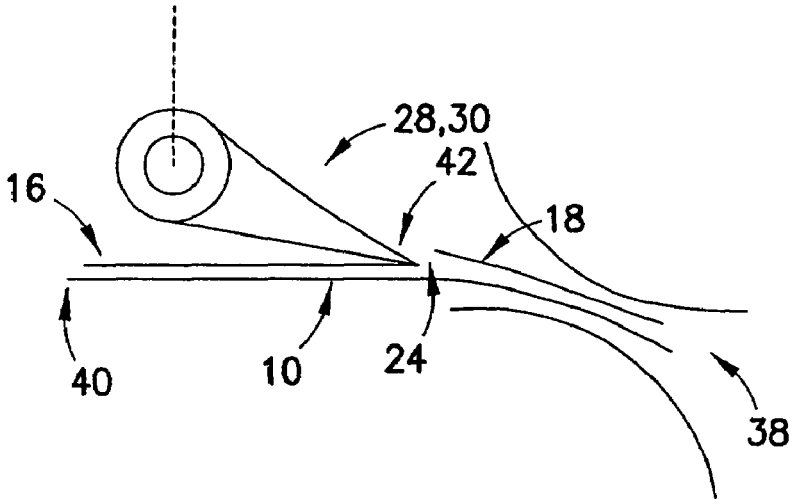
FIGS. 6 and 7 are schematic representations of an automated envelope opening system for use with the envelope described in FIGS. 1 and 2.
Figure 7:
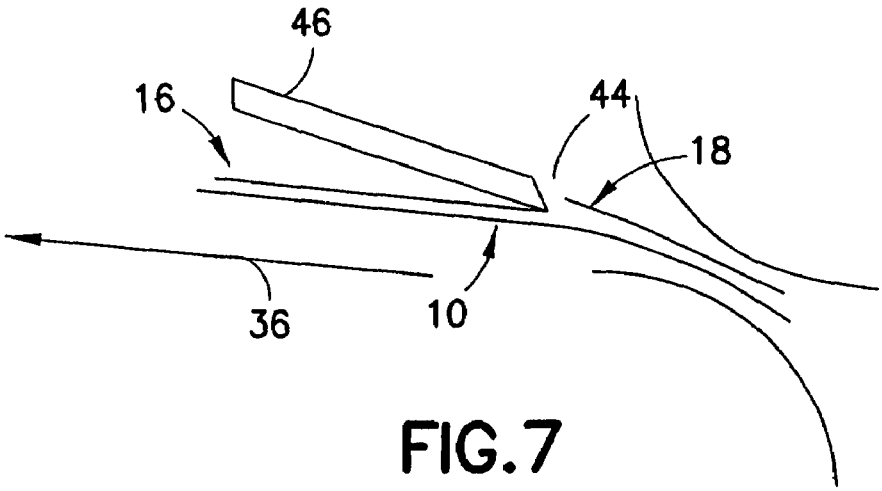
Figure 8:
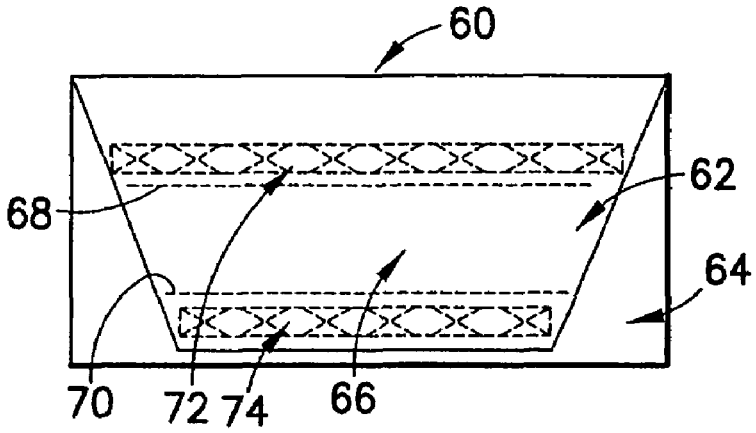
FIG. 8 is a schematic representation of the flap side of an envelope for containing and authenticating a ballot in a second embodiment of the present invention.
Figure 9:
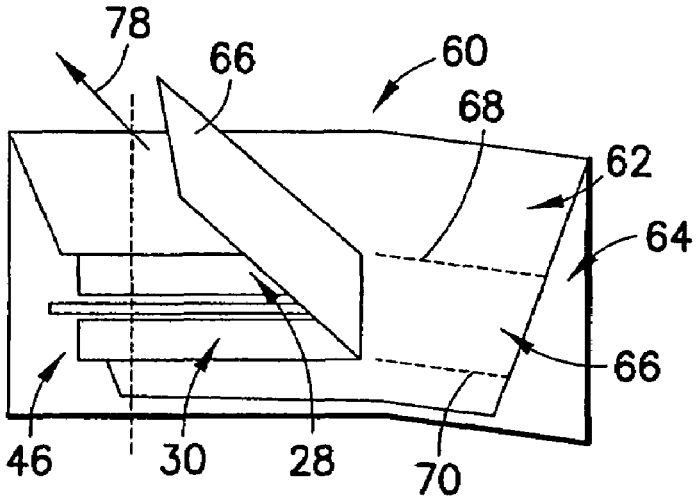
FIG. 9 is a schematic representation of the flap side of the envelope of FIG. 8 showing the pre-cut window cover lifted by the opening fingers for removal from the flap.
Figure 10:
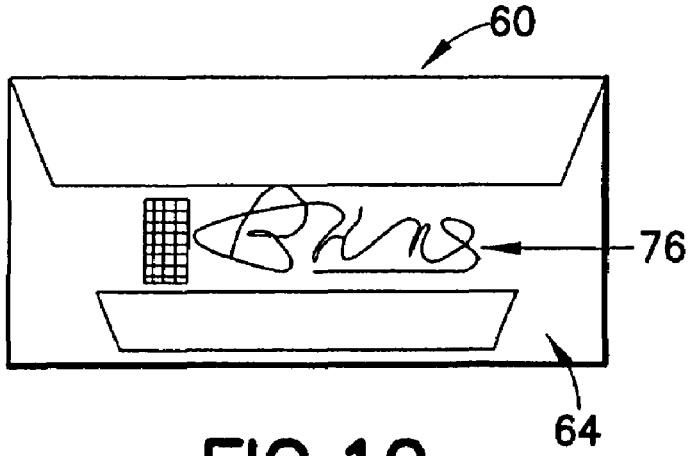
FIG. 10 is a schematic representation of the flap side of the envelope of FIG. 8 showing the signature area of the envelope removed to reveal the signature area.
Figure 11:
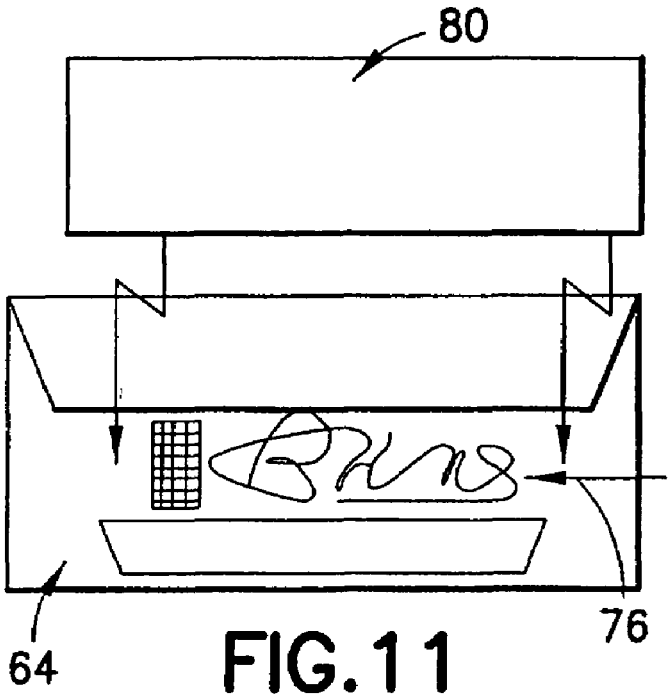
FIG. 11 is a schematic representation of the flap side of the envelope of FIG. 8 showing an opaque sticker applied over the signature to conceal the signature area.

Turning now to the drawings and considering the invention in further detail with particular reference to FIGS. 1-7, an envelope for use in containing and authenticating a ballot is illustrated therein and generally designated 10. The envelope 10 includes a containment region dimensioned for receipt of a ballot or other desired document in accordance with the particular application with which the envelope is used. The back side 12 of the envelope 10 includes a pre-defined area generally designated 14 which area typically holds the signature of the voter corresponding to the ballot contained by the envelope. The envelope includes a flap portion generally designated 16 and folding over the back 12 of the envelope for sealing the containment region. The flap portion 16 also contains a pre-cut window generally designated 18 substantially in registration with the pre-defined signature area 14. The flap portion 16 includes an upper edge flap seal strip on the flap side toward the back side 12 of the envelope 10 to seal the containment region when the flap 16 is folded and pressed toward the back side 12 of the envelope. The flap portion 16 includes a lower edge flap seal strip 22 on the side of the flap portion 16 facing the back side 12 of the envelope 10 to seal the flap portion 16 along the second sealing strip 22 at the bottom of the back side 12 of the envelope 10 thereby covering the signature area 14. The sealing strips 20 and 22 are located in a region above and below the pre-cut window 18 and extend in a width-wise direction of the envelope and may be of any suitable sealing means to carry out the intended function. For example, the strips may be an adhesive protected by a releasable covering that is removed when the envelope is closed. The window cover 18 is defined by a pre-cut section of the area of the flap portion 16 between the upper and lower edge flap seal strips 20, 22 respectively. The window cover 18 also includes an open slit 24 in one end 26 of the window cover 18 and is dimensioned to receive mechanical opening fingers 28, 30. Window cover 18 preferably includes pre-made horizontal perforations along its upper and lower borders. These perforations allow easier opening of the window cover. When the envelope 10 moves through an automated window cover opening machine as illustrated schematically in FIGS. 6 and 7, the fingers 28, 30 lift the window cover in a direction 32 away from the flap portion 16 and the envelope 10 as best shown in FIG. 3 to remove the window cover to reveal the pre-defined signature area 14. The signature area 14 is re-obscured by applying an opaque covering 34 in place of the window cover 18 as illustrated in FIG. 5.

The window cover 18 is removed by the automated window cover opening machine as the envelope moves in the direction indicated by the direction arrow 36 by means of a roller nip 38 moving the envelope leading edge 40 past the opening fingers 28, 30 such that the tip end 42 enters the open slit 24 of the window cover. The envelope is slightly bent as it passes through the nib 38 to optimize the slit opening to facilitate entry of the tip end 42 of the opening fingers 28, 30 into the slit opening. The slit opening may be further optimized by blowing air into the slit opening from the end 44 of an air tube 46 suitably arranged in the region of the mechanical opening fingers 28, 30. It will be appreciated that the cover 18 can also be removed manually. The signature area 14 that is revealed when the window cover 18 is removed may be re-obscured by applying an opaque sticker 34 to replace the window cover 18 to re-conceal the signature area. Alternately, the inside face of window cover 18 could be coated with a sticky adhesive (such as that used on "Post-IT Notes" by 3M) such that the window cover could be re-applied to the window after it has been removed to reveal the signature.

Figure 12:
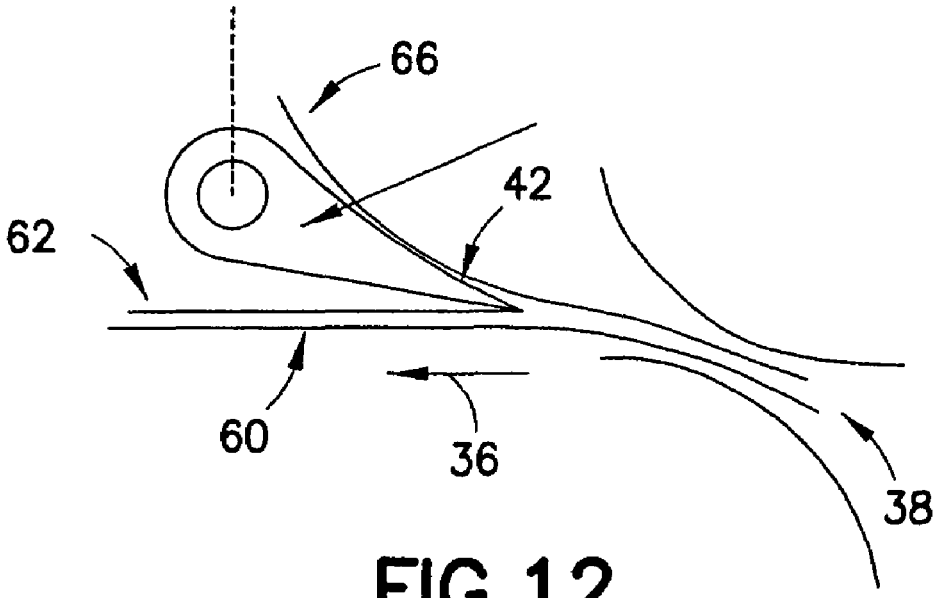
FIG. 12 is a schematic representation of an automated envelope opening system for use with the envelope described in FIG. 8.
Figure 13:
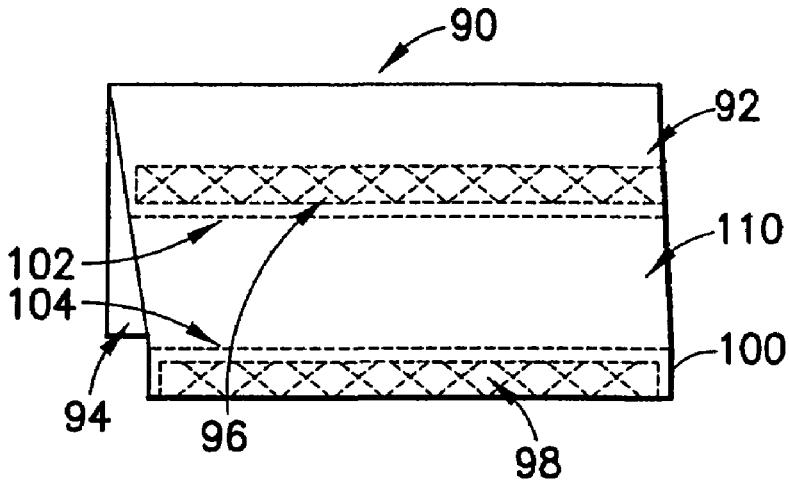
FIG. 13 is a schematic representation of the flap side of an envelope for containing and authenticating a ballot in a third embodiment of the present invention.
Figure 14:
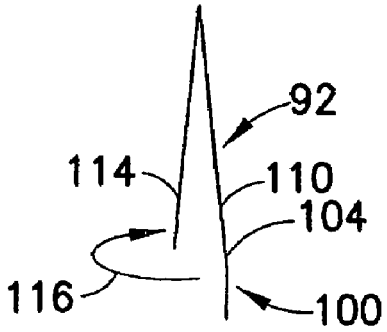
FIG. 14 is a schematic side view of the envelope of FIG. 13 showing the flap bottom fold over portion of the flap extending below the bottom edge of the envelope body for folding to the envelope front face.
Figure 15:
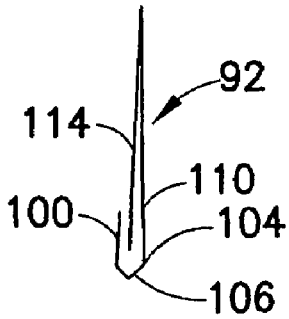
FIG. 15 is a schematic side view of the envelope of FIG. 17 showing the flap bottom fold over portion of the flap attached to the lower front face surface of the envelope.
Figure 16:
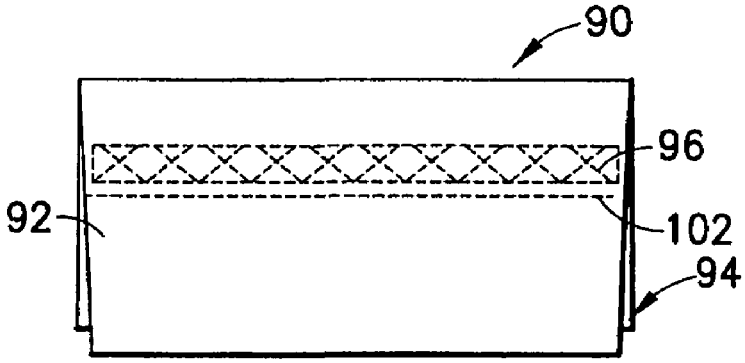
FIG. 16 is a schematic rear plan view of the envelope of FIG. 13 with the flap bottom fold over portion of the flap attached to the front face surface.
Figure 17:
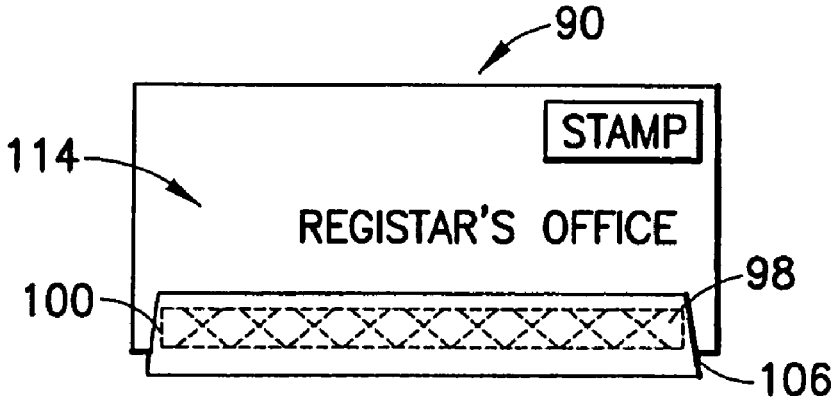
FIG. 17 is a schematic front plan view of the envelope of FIG. 13 showing the flap bottom fold over portion attached to the front face surface.
Figure 19:
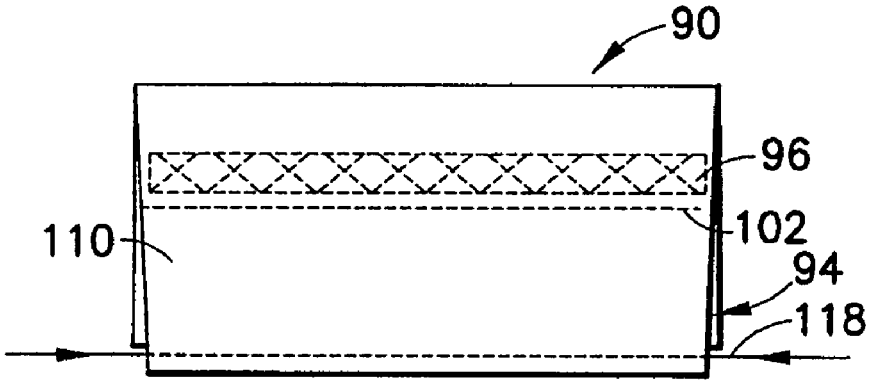
FIG. 19 is a schematic rear plan view of the envelope of FIGS. 17 and 18 showing the folded band of the flap bottom fold over portion slit to allow the window cover portion of the flap to be folded up away from the back of the envelope.
Figure 18:
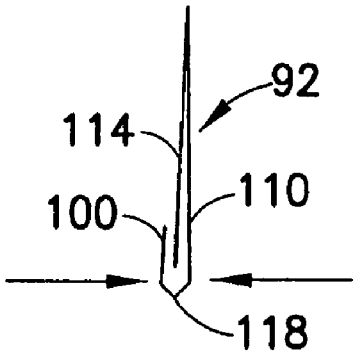
FIG. 18 is a side schematic view of the envelope of FIGS. 16 and 17 showing folded band of the flap bottom fold over portion of the flap forming the bottom of the envelope.
Figure 20:
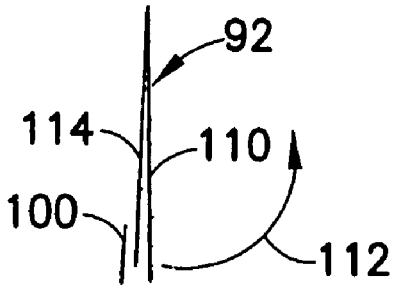
FIG. 20 is a side schematic view of the envelope of FIG. 19.
Figure 21:
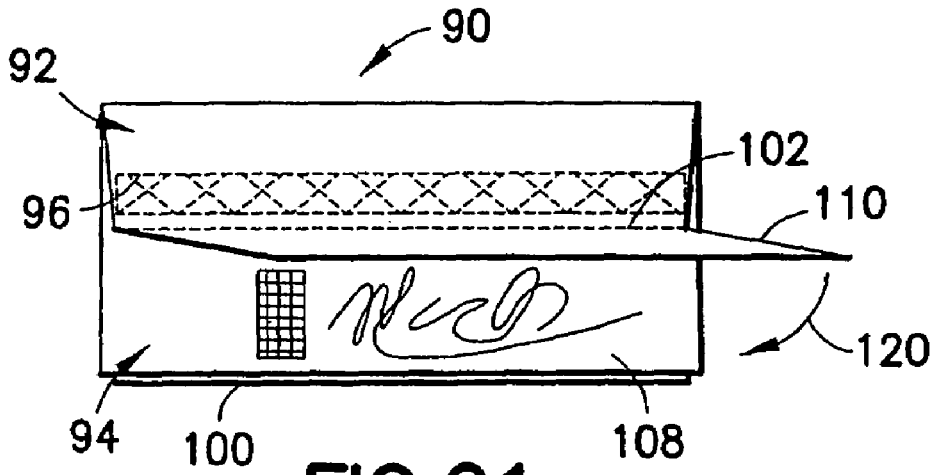
FIG. 21 is a schematic rear view of the envelope of FIG. 13 showing the window cover portion of the flap flipped up to reveal the signature area.
Figure 22:
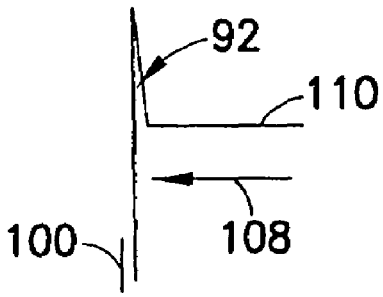
FIG. 22 is a schematic side view of the envelope illustrated in FIG. 21.
Figure 23:
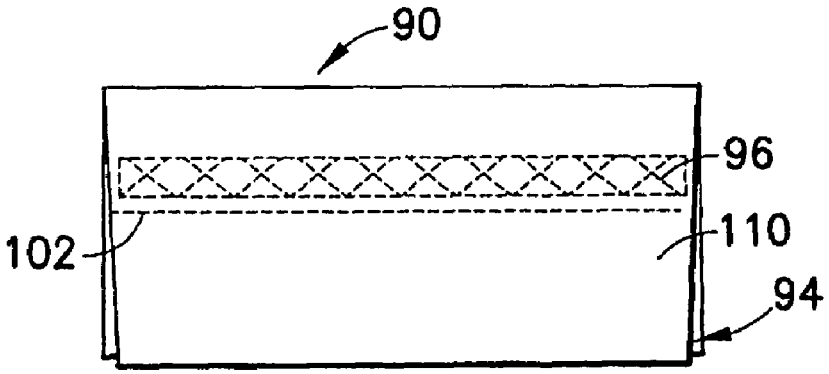
FIG. 23 is a schematic rear view of the envelope of FIG. 21 showing the window cover portion of the flap reattached to the back of the envelope to re-conceal the signature area.

Turning now to FIGS. 8-12, an envelope for use in containing and authenticating a ballot is illustrated therein in a second embodiment and generally designated 60. The envelope includes a containment region is dimensioned for receipt of a ballot and includes a pre-defined signature area on the back side 64 of the envelope 60. A flap portion 62 seals the containment region and covers the pre-defined signature area 76 by means of a window cover 66 substantially in registration of the signature area 76 to obscure the signature area when the flap portion 62 is folded toward the back side 64 of the envelope 60. The window cover 66 is defined by the area of the flap portion between an upper edge flap seal strip 72 and a lower edge flap seal strip 74 by means of a width-wise perforation inward of each of the flap seal strips 72, 74 and extending between the side edges of the flap portion 62. The signature area 76 is revealed by tearing the window cover 66 along the perforations 68, 70 in the direction away from the back side 64 of the envelope as indicated by the direction arrow 78. In this embodiment, the mechanical opening fingers 28, 30 engage directly below the window cover 66 through the edge of the flap to pass between the window cover 66 and the back side 64 of the envelope 60. As seen in FIG. 12, the tip end 44 of the mechanical opening fingers 28, 30 enters beneath the window cover 66 as the envelope 60 is moved by the nib 38 in the moving direction 36 of the envelope 60 to remove the window cover 66. The envelope is slightly bent by the action of the rollers forming the nib 38 to optimize the opening between the window cover 66 and the back side 64 of the envelope. The opening between the window cover 66 and the back side 64 of the envelope may be further optimized by blowing air through an air tube 46 appropriately arranged with the opening fingers 28, 30 as described above. It will be appreciated that cover 66 may also be removed manually. The signature area 76 that is revealed when the window cover 66 is removed may be re-obscured by applying an opaque sticker 80 to replace the window cover 66 to re-conceal the signature area.

Turning now to FIGS. 13-23, an envelope for use in containing and authenticating a ballot is illustrated therein in a third embodiment and generally designated 90. The envelope 90 includes a containment region dimensioned for receipt of a ballot and the backside 94 includes a pre-defined area 108 for containing a signature of the person returning the ballot. The flap portion 92 includes an upper edge flap seal strip 96 arranged to face the back side 94 of the envelope when the flap 92 is folded toward the back side of the envelope to seal the ballot within containment region of the envelope. The flap portion 92 also includes a bottom fold over portion 100 which is folded along the fold line 104 to face the front face 114 of the envelope 90. A lower seal strip 98 is carried on the side of the bottom fold over portion 100 facing the front face 114 of the envelope 90 to hold the flap in a closed position. A window cover 110 is defined in the region of the flap portion 92 between the fold lines 102 and 104 to cover the pre-defined signature area 108 when the flap is in the closed position. A narrow band of folded flap 106 is created when the bottom fold over portion 100 of the flap is folded in the direction 116 toward the front face 114 of the envelope. When the envelope is received at the registrars office, the narrow band folded flap 106 is cut along the bottom slit line 118 to separate the bottom fold over portion 100 adhered to the front surface 114 of the envelope from the remaining portion of the flap portion 92. The window cover 110 of the flap portion 92 is lifted in the direction indicated by the arrow 112 away from the back side 94 of the envelope to reveal the signature area 108. The window cover 110 is then folded back toward the back side 94 of the envelope in the direction 120 to re-conceal the signature area 108. The window cover 110 may be glued or otherwise adhered to the back side 94 of the envelope the side of the window cover facing the back side 94 of the envelope may carry a suitable adhesive means or an adhesive may be applied utilizing any suitable means to carry out the function to reseal the window cover to the backside of the envelope to re-conceal the signature area.

Figure 24:
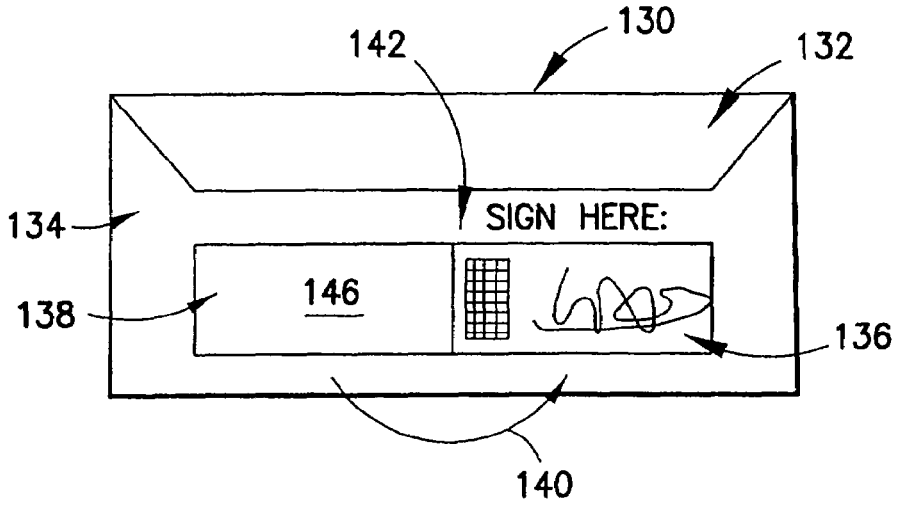
FIG. 24 is a schematic representation of the back side of an envelope for containing and authenticating a ballot in a fourth embodiment of the present invention.
Figure 25:
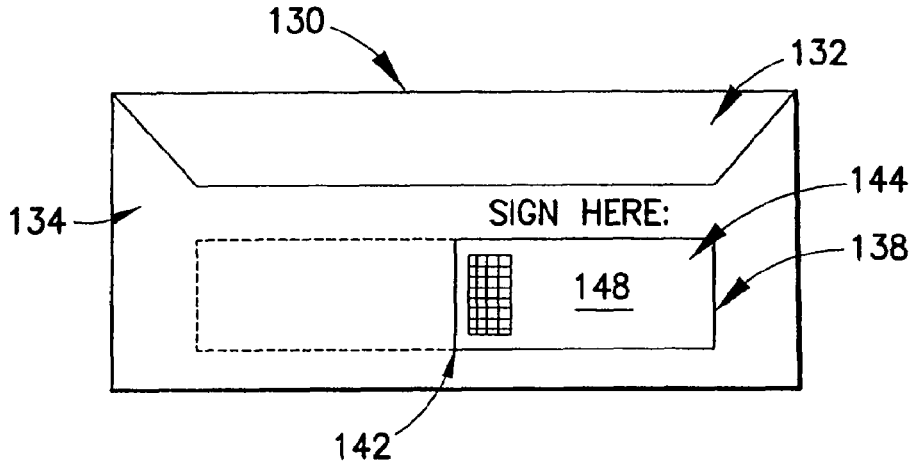
FIG. 25 is a schematic representation of the envelope of FIG. 24 showing the signature area covered by an opaque layer.
Figure 26:
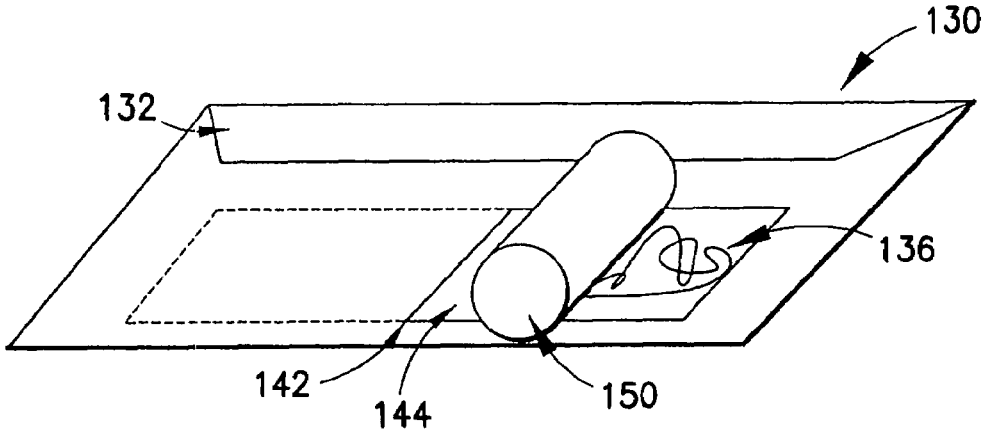
FIG. 26 shows the envelope of FIG. 25 with the opaque layer removed to reveal the signature area.

Turning now to FIGS. 24-26, an envelope for use in containing and authenticating a ballot is illustrated therein and generally designated 130. The envelope 130 includes a containment region for receipt of a ballot. A pre-defined area 136 for carrying a signature of the person casting the ballot is located on the back side 134 of the envelope 130. A flap portion 132 located outside the pre-defined area is used to seal the containment region of the envelope. A window cover 138 is also carried on the back side 134 of the envelope 130 and is folded in the direction indicated by the direction arrow 140 along the fold line 142 toward the signature area 136 to conceal the pre-defined signature area. The surface 146 of the window cover 138 facing the signature area 136 when the window cover is folded over the signature area is a sticky surface and carries a suitable adhesive so that the window cover is glued or otherwise adhered over the signature area when in contact with the area. The window cover 138 is made of a suitable transparent material and carries an opaque layer 144 on its outwardly facing surface 148 when the window cover 138 is folded over the signature area 136 to conceal the signature area. When the envelope is received at the registrars office, the signature area 136 is revealed by removing the opaque layer 144 by using one or more scratch rolls 150 to reveal the signature area 136 through the transparent window cover 138. A new opaque layer may be applied on top of the transparent window cover after the signature is revealed to re-conceal the signature. The opaque layer may be of any suitable material to carry out the intended function for example the materials used on "scratch off" cards which are well known in the art and to the general public. Alternately, the opaque layer may be removable through a chemical rather than mechanical process. In a further embodiment, the other physical properties may be applied to remove the opaque layer, or to make the opaque layer transparent. Such physical properties may include heat, pressure, radiation, or magnetism.

An envelope for use in containing and authenticating a ballot has been presented above in several exemplary embodiments. It will be recognized by those skilled in the art that changes and modifications may be made without departing from the spirit and scope of the invention for example, individual flap seal strips are disclosed to seal the flap portion on either side of the signature area wherein the window cover is defined between the sealed strips. In order to avoid that the voter may forget to seal the flap along the upper seal strip, the seal strips may have one protective releasable covering that when removed exposes the adhesive side of both the upper and lower edge flap seal strips such that the seal strips adhere to the envelope when the flap is folded closed. Accordingly, the invention has been presented by way of illustration rather than limitation.

Also, while the preferred embodiments have been described in connection with governmental voting, it will be understood that the invention may be used in the private sector, for example, corporate shareholder voting.

What is claimed is:

1. An envelope for use in containing and authenticating a ballot comprising:

a containment region dimensioned for receipt of a ballot;

a pre-defined area on the back of the envelope;

a flap portion outside said pre-defined area for sealing the containment region, said flap portion including a first sealing means in a region above said pre-defined area and a second sealing means in a region below said pre-defined area;

a window cover substantially in registration with said pre-defined area for obscuring said pre-defined area in a first operative configuration, and for revealing said pre-defined area in a second operative configuration, said window cover defined by a pre-cut section of the area of said flap portion between said first and second sealing means in a width wise direction of the envelope and including an open slit in one end of the pre-cut section dimensioned for receiving at least one mechanical opening finger as the envelope moves through an automated window cover opening machine to remove said window cover wherein said pre-defined area is uncovered and revealed; and means for re-obscuring said pre-defined area after the pre-defined area has been revealed, whereby the ballot remains sealed during said pre-defined area obscured, revealed and re-obscured configurations.

2. The envelope as defined in claim 1 wherein said means for re-obscuring is an opaque covering applied in place of said window cover.

3. The envelope as defined in claim 1 wherein said window cover further includes means for adhering coated on the inside face of said window cover, and said means for re-obscuring is arranged to close and adhere said window cover to said pre-defined area.

4. The envelope as defined in claim 1 wherein said pre-defined area is dimensioned for receipt of a signature.

5. An envelope for use in containing and authenticating a ballot comprising;

a containment region dimensioned for receipt of a ballot;

a pre-defined area on the back of the envelope;

a flap portion outside said pre-defined area for sealing the containment region, said flap portion including a first sealing means in a region above said pre-defined area and a second sealing means in a region below said pre-defined area;

a window cover substantially in registration with said pre-defined area for obscuring said pre-defined area in a first operative configuration, and for revealing said pre-defined area in a second operative configuration, said window cover defined by the area of the flap section between said first and second sealing means and including a perforation inward of each of said first and second sealing means and extending between the side edges of said flap portion, said window cover arranged to receive at least one mechanical opening finger between the back of the envelope and the window cover as the envelope moves through an automated window cover opening machine to remove said window cover wherein said pre-defined area is uncovered and revealed; and means for re-obscuring said pre-defined area after the pre-defined area has been revealed, whereby the ballot remains sealed during said pre-defined area obscured, revealed and re-obscured configurations.

6. The envelope as defined in claim 5 wherein said means for re-obscuring is an opaque covering applied in place of said window cover.

7. An envelope for use in containing and authenticating a ballot comprising;

a containment region dimensioned for receipt of a ballot;

a pre-defined area on the back of the envelope;

a flap portion outside said pre-defined area for sealing the containment region, said flap portion having a length dimension greater than a length dimension of a back of the envelope and a lower fold line along which a bottom part of the flap portion is folded over a bottom part of the envelope to a front bottom side of the envelope to define a narrow band of folded flap along an outside of the bottom part of the envelope;

a first sealing means in a region above said pre-defined area;

a second sealing means along the flap portion folded part facing the front bottom side of the envelope;

an upper fold line in a region above said pre-defined area and below said first sealing means;

a window cover substantially in registration with said pre-defined area for obscuring said pre-defined area in a first operative configuration, and for revealing said pre-defined area in a second operative configuration, said window cover defined by the area of the flap section between said upper fold line and said lower fold line whereby said pre-defined area is sealed and obscured from view, said window cover further being arranged to reveal said pre-defined area when said flap portion is separated along its said lower fold line and lifted outwardly away from the back of the envelope along said upper fold line; and means for re-obscuring said pre-defined area after the pre-defined area has been revealed;

whereby the ballot remains sealed during said pre-defined area obscured, revealed and re-obscured configurations.

8. The envelope as defined in claim 7 wherein said means for re-obscuring is to have the lifted part of said window cover folded toward and adhered to the back of the envelope.

9. An envelope for use in containing and authenticating a ballot comprising:

a containment region dimensioned for receipt a ballot;

a pre-defined area on the back of the envelope;

a flap portion outside said pre-defined area for sealing the containment region, said flap portion including a window cover substantially in registration with said pre-defined area for obscuring said pre-defined area in a first operative configuration, and for revealing said pre-defined area in a second operative configuration, said window cover including a sticker carried on the back of the envelope and made of a suitable transparent material having a sticky surface side and an opposite surface side having an opaque layer wherein said sticker is applied over said pre-defined area with the sticky surface side facing said pre-defined area and with said opaque surface side facing outward, whereby said pre-defined area is obscured from view, said opaque layer further being removable by suitable means to reveal said pre-defined area through said transparent material; and means for re-obscuring said pre-defined area after the pre-defined area has been Revealed;

whereby the ballot remains sealed during said pre-defined area obscured, revealed and re-obscured configurations.

10. The envelope as defined in claim 9 wherein said re-obscuring means is a further opaque layer applied to said sticker opposite surface side in place of said removed opaque layer.

11. The envelope as defined in claim 9 wherein said re-obscuring means is an opaque covering applied to said sticker opposite surface side in place of said removed opaque layer.

12. The envelope as defined in claim 9 wherein said opaque layer is a scratch-off material layer removable by mechanical means.

13. The envelope as defined in claim 9 wherein said opaque layer is removable by a suitable chemical process.

14. The envelope as defined in claim 9 wherein the opaque layer is removable by a suitable process selected from the group of heat, pressure, radiation, and magnetism.

15. Method for processing an envelope for use in containing and authenticating a ballot comprising the steps of:

receiving the envelope having a signature applied to a pre-defined area on a back side of the of the envelope, the envelope containing a ballot sealed in a containment region of the envelope by a flap portion outside the pre-defined area, the flap portion having a window cover substantially in registration with the pre-defined area to obscure the pre-defined area in a first operative configuration, the window cover including a slit for receiving at least one mechanical opening finger;

removing the window cover using the at least one mechanical opening finger as the envelope moves to reveal the pre-defined area in a second operative configuration; and re-obscuring the pre-defined area after the pre-defined area has been revealed, whereby the ballot remains sealed during the pre-defined area obscured, revealed and re-obscured configurations.

16. The method as defined in claim 15 wherein the step of removing the window cover includes inserting the at least one mechanical finger into the slit and under the window cover to tear it open.

17. Method for processing an envelope for use in containing and authenticating a ballot comprising the steps of:

receiving the envelope having a signature applied to a pre-defined area on a back side of the envelope, the envelope containing a ballot sealed in a containment region of the envelope by a flap portion outside the pre-defined area, the flap portion having a window cover substantially in registration with the pre-defined area, the window cover including a transparent material having a sticky surface side and an oppositely disposed opaque layer side, the window cover folded about a fold line so that the sticky surface side is in contact with the pre-defined area to obscure the pre-defined area by the outwardly facing opaque layer in a first operative configuration;

removing the opaque layer to reveal the pre-defined area through the transparent material in a second operative configuration; and re-obscuring the pre-defined area after the pre-defined area has been revealed by re-applying an opaque layer to the window cover to re-obscure the pre-defined area, wherein the ballot remains sealed during the predefined area obscured, revealed and re-obscured configurations.

* * * * *